US007288016B2

(12) United States Patent
Juy

(10) Patent No.: US 7,288,016 B2
(45) Date of Patent: Oct. 30, 2007

(54) IGNITER MECHANISM FOR TOY HAND GRENADE

(76) Inventor: King Sun Juy, Flat A, 22/F, Block 1, Charming Garden, Mongkok, Kowloon (HK)

( * ) Notice: Subject to any disclaimer, the term of this patent is extended or adjusted under 35 U.S.C. 154(b) by 234 days.

(21) Appl. No.: 11/151,322

(22) Filed: Jun. 14, 2005

(65) Prior Publication Data

US 2006/0278115 A1 Dec. 14, 2006

(51) Int. Cl.
*A63H 5/00* (2006.01)
*A63H 5/04* (2006.01)

(52) U.S. Cl. ..... 446/398; 446/401; 434/11

(58) Field of Classification Search ..... 446/398, 446/400, 401, 473; 434/11; 102/498, 482
See application file for complete search history.

(56) References Cited

U.S. PATENT DOCUMENTS 4,059,917 A * 11/1977 Sims et al. ..... 446/398
4,319,426 A * 3/1982 Lee ..... 446/401
4,932,329 A * 6/1990 Logie ..... 102/498
5,018,449 A * 5/1991 Eidson, II ..... 102/498
5,240,450 A * 8/1993 Graham ..... 446/267
5,246,372 A * 9/1993 Campagnuolo et al. ..... 434/11
5,354,225 A * 10/1994 Hix ..... 446/180

* cited by examiner

*Primary Examiner*—Kien T Nguyen
(74) *Attorney, Agent, or Firm*—Rabin & Berdo, P.C.

(57) ABSTRACT

The present invention relates to an igniter mechanism for a toy hand grenade which comprises a pull string ignition assembly, a housing that encases the pull string ignition assembly and a stopper that is located in the housing. The igniter mechanism may meet the requirements of safety, reliability and low production cost.

9 Claims, 2 Drawing Sheets

IGNITER MECHANISM FOR TOY HAND GRENADE

BACKGROUND OF THE INVENTION

The present invention relates to an ignition apparatus and, more particularly, to an igniter mechanism for a toy hand grenade.

Toy hand grenades have been utilized in the prior art for entertainment and amusement. To ignite this type of toy hand grenade, there have been numerous igniters used therein. However, most of these are quite complex and utilize mechanical springs and levers for triggering the ignition. Some of these arrangements utilize a pull-wire having at the opposite end a crimped friction arrangement. This utilizes the draw friction obtained by pulling the wire, coated with a scratch material. The friction between these two materials as the wire is drawn through it causes the ignition of the fuse, which in turn, ignites the pyrotechnic material.

For example, in the prior art toy hand grenade which is commercially available, the igniter composition is ignited by means of friction between a metallic pull wire and a metallic cup on both of which a scratch material is coated. As such the metallic members are easy to gather rust so that this type of products must be used before the end of the prescribed period. Also, it is poor in ignition effect and higher in production cost. Moreover, the problems presented by igniting a toy hand grenade are considerably different that ones addressee by the prior art devices.

SUMMARY OF THE INVENTION

As a result of these disadvantages and in order to meet the requirements of safety, reliability and low production cost, it is an object of the present invention to provide an igniter mechanism for a toy hand grenade.

The toy hand grenade according to the present invention consists of a grenade body and a reliable pull-string igniter mechanism. The grenade body can be formed in many different arrangements. For the sake of illustration, this application will be directed to a real hand grenade configuration. Naturally, the igniter mechanism according to the present invention may be used for igniting any firework with fuse.

The igniter mechanism in accordance with the present invention is attached to one side of the grenade body.

This igniter mechanism comprises:

A pull-string ignition assembly that includes a cotton paper, a chemical igniter composition lain on the paper, a fuse train and a pull string; a housing that encases the pull-string ignition assembly; and a stopper that is located in the housing and closes on end of the housing as well as through that the pull string is passed.

The pull-string ignition assembly is rolled into a cylindrical form. The housing is a long, hollow, thin cylinder, on one end of which an opening is provided and on another one of which a hole through that the pull string is passed and/or a narrow gap are provided. For the convenience of putting the ignition assembly into the housing, a recess is provided longitudinally on the side surface of the housing. Also, on the outside of the housing a safety lever is located which is integrally formed with a lid cap. The lid cap is fixed at one end of the grenade body. The stopper is placed in the housing and closes one end of the housing. At the center of the stopper a through-hole is formed, through which the pull string is passed. The stopper serves to prevent sparks form being thrown out from the hole of the housing when a pulling force is applied downwardly to the pull-string and friction there between causes sparks to affect the ignition operation of the toy hand grenade.

Obviously, the present invention has found a way to solve the problems which have been encountered with the prior art and now provides new and unobvious results that have not been known before.

It should be understood that this igniter mechanism of the present invention can be utilized in many different devices and is not limited to a toy hand grenade as shown and illustrated in this application. For example, it may be used for igniting any firework with fuse.

BRIEF DESCRIPTION OF THE DRAWINGS

In what follows, the present invention will describe in more detail with reference to the appended drawings.

DETAILED DESCRIPTION OF THE INVENTION

Figure 1:
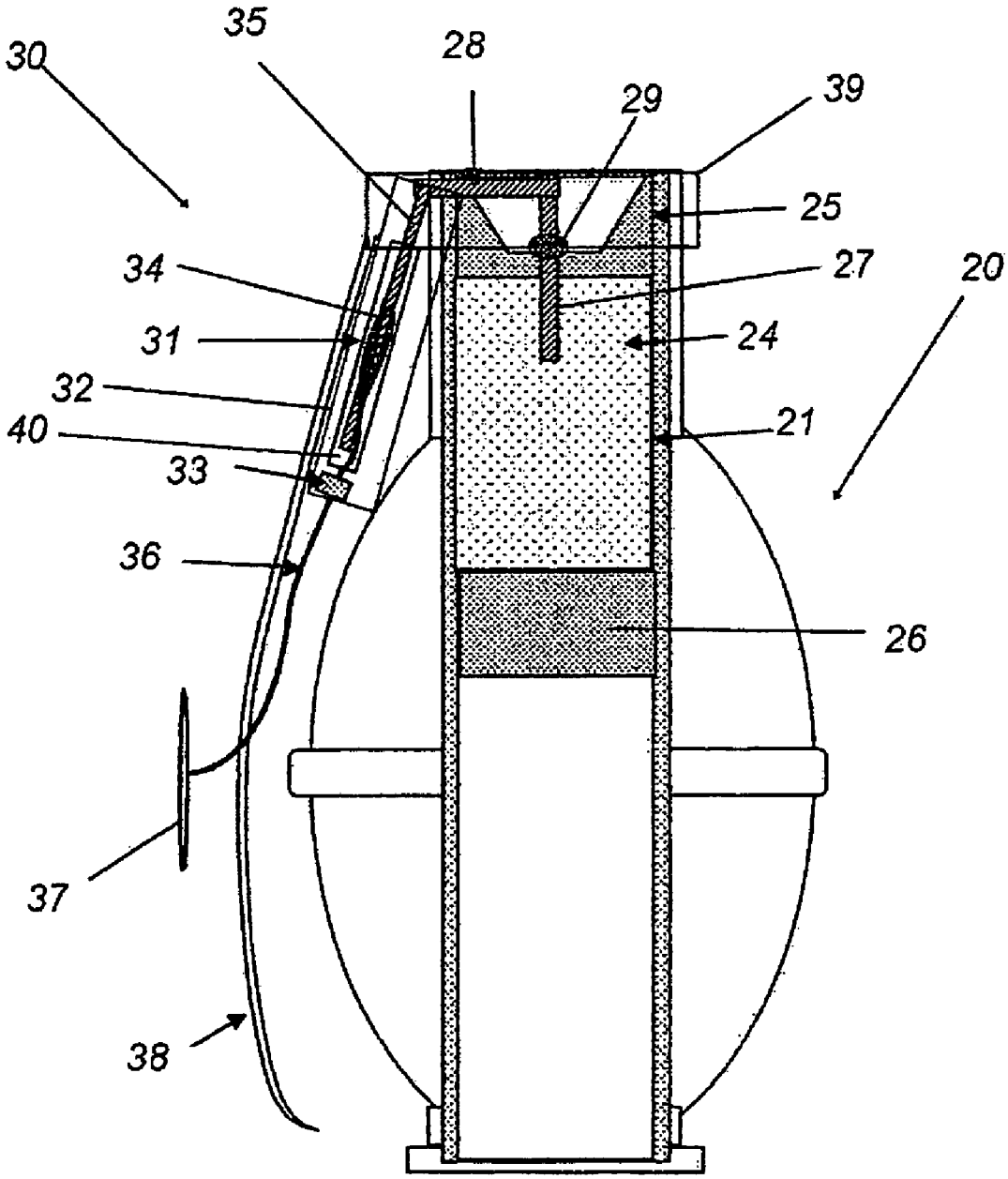
FIG. 1 shows a partially sectional schematic view of a toy hand grenade which incorporates the igniter mechanism of the present invention.

Turning now more specifically to the drawings, FIG. 1 shows a toy hand grenade, which substantially consists of a grenade body 20 and an igniter mechanism 30. In the grenade body 20, an elongated tubular body 21 is received which can be formed from paper, plastic, metal or any other suitable materials. In the preferred embodiment, the body 21 can be formed in with a multi-layer configuration wherein the layers are held together with a suitable adhesive. In this way, a relatively strong hollow tubular structure is provided which is at least partially loaded with a suitable burnable pyrotechnic composition or mixture 24. Such burnable material is sandwiched between two clay layers 25, 26. A central inner passageway 27 can be provided within the clay layer 25 and extended into the pyrotechnic composition or mixture 24. A safety green fuse 28 can be inserted there into. Also, a primer 29 is combined with the safety fuse 28. It should be noted that the pyrotechnic mixture needs to be properly compacted and formed during the loading process in order to obtain a continuous and reliable burning of the mixture.

The igniter mechanism 30 in accordance with the present invention comprises a pull-string ignition assembly 31, a housing 32 and a stopper 33.

The pull-string ignition assembly 31 is configurated in a following manner:

a) a chemical igniter composition such as a suitable phosphorous scratch mix 34 is coated on a cotton paper and one end portion of the pull string is coated with a igniter mixture;

b) a fuse train 35 and a pull string 36 being 150 mm long are placed on the paper, in which one end of the pull string can be crimped in a zigzag configuration or the pull string can be abutted against the fuse train 35; and c) The obtained ignition assembly 31 is then rolled into a cylindrical form having a diameter of 4 mm.

The one end of fuse train 35 is connected in a burnable manner to the fuse 28. A pulling ring 37 is held at the end of the pull string 36 to be pulled. This allows the pull string 36 to be easily withdrawn.

The housing 32 is a long, hollow, thin cylinder on one end of which an opening is provided and another end of which has a hole and/or a narrow gap. The fuse train 35 is connected through the opening to the fuse 28. The pull string is extended through the hole or the gap to outside of the housing. For the convenience of placing the pull-string ignition assembly 31 into the housing 32, a guide recess 40 is provided on the housing 32 in a direction parallel to the axis thereof and the narrow gap is communicated with the recess and the hole. The guide recess 40 has a width which is slightly more than the diameter of the pull string ignition assembly 31 so that the assembly 31 is easy to be introduced into the housing through the guide recess 40.

A novel feature of the present invention is the addition of a stopper 33 rested on one end of the housing 32. The stopper 33 is made of elastic material, such as rubber. This stopper 33 is approximately 5 mm in diameter and approximately 4 mm high. A through-hole is formed at the center of the stopper. The pull string 36 passes through the central aperture provided therein and the hole or the gap provided in the housing 32 to outside of the housing 32. The purpose of the stopper 33 is to automatically and simultaneously close the hole on the housing when withdrawing the pull-string to ignite the toy hand grenade and to prevent sparks from being thrown out from the hole or the gap. Thus, in use, the toy hand grenade of the present invention can prevent sparks, flame and gases from traveling down through the hole to endanger the user.

Further, a safety lever 38 is held outside of the housing 32, which is integrally formed with a lid cap 39. The lid cap is held on top end of the grenade body 20 in a snap-on manner. Thus, the lid cap with the safety lever 38 is able to be easily released or mounted. Also, an opening is provided on the central portion of the lid cap, on which a label is attached. In order to keep the pulling ring 37 on the lever 38, a recess is formed on the safety lever 38 to receive the pull string 36, an opening of which is provided on one side of the lever. The recess is extended from the opening in a transverse direction and then in a longitudinal direction so that the recess is in the form of inverted "L".

Figure 2:
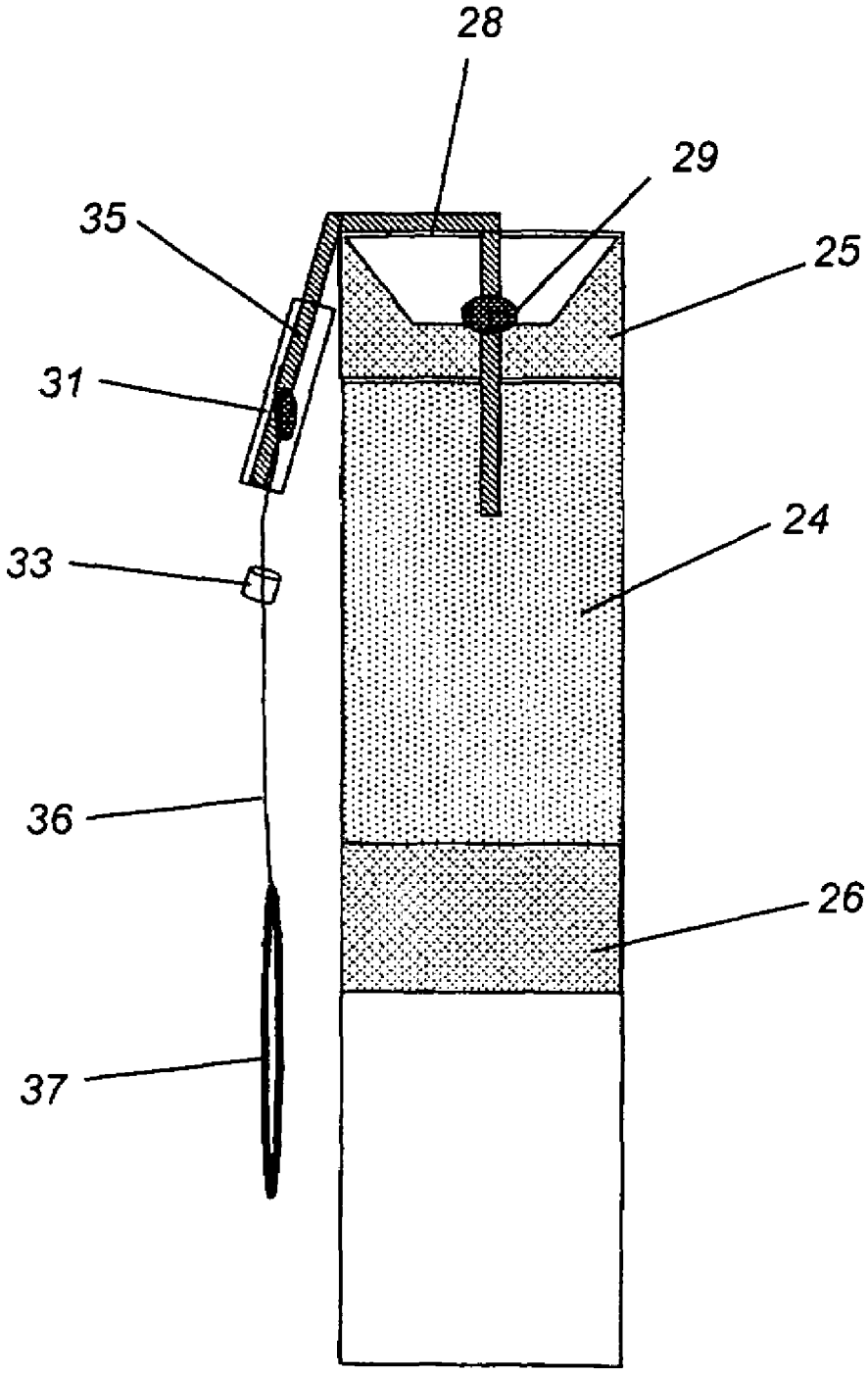
FIG. 2 shows the same toy hand grenade as shown in FIG. 1 with the lid cup, the safety lever, the housing and partial body removed as well as the pull-string ignition assembly exposed.

Referring now to FIG. 2, when it is desired to ignite the toy hand grenade, the lid cap 39 with the safety lever 38 may be kept. The pulling ring 37 is then grasped and pulled sharply downward and away from the end of the housing 32. The motion causes the friction compound to provide a flash. This flash ignites the fuse 35 causing an intense flame to be generated. At this time, sparks, flame and gases to endanger the user can be prevented from passing through the hole or the gap on the housing 32 as there is a stopper 33 in the housing 32. For the purpose of safety, the 3 cm pull string needs to be kept in the housing. Under this circumstance, 3 cm motion, when pulling the ring downward, does not cause the friction and the flash is not provided.

Once withdrawing the pull string, this motion will cause the fuse train 35 to be burned which in turn burns the predetermined length of safety green fuse 28 until the pyrotechnic composition included therein is detonated. Also, the label on the lid cap is burned through. Usually, the toy hand grenade has to be immediately thrown down upon an open place beyond 10 meters. It will take about 3 to 9 seconds from withdrawing the pull string to detonating the toy hand grenade.

Although an igniter mechanism for toy hand grenade has been shown and described in the application, it should be understood that this invention is not to be limited to the exact form disclosed, and changes in detail and construction of the invention may be made without departing from the spirit thereof.

What the claimed is:

1. An igniter mechanism for a toy hand grenade, comprising:

a pull-string ignition assembly that includes a cotton paper, a chemical igniter composition disposed on the paper, a fuse train and a pull string;

a housing that encases the pull-string ignition assembly; and a stopper that is located in the housing and closes one end thereof, the pull string passing through the stopper.

2. The igniter mechanism according to claim 1, wherein the pull-string ignition assembly is rolled into a cylindrical form.

3. The igniter mechanism according to claim 2, wherein the pull-string ignition assembly has a diameter of 4 mm.

4. The igniter mechanism according to claim 1, wherein the housing is a long, hollow, thin cylinder, on one end of which an opening is provided and on an other end of which a hole through that the pull string is passed and/or a narrow gap are provided.

5. The igniter mechanism according to claim 4, wherein a guide recess is provided on the outside surface of the housing in a direction parallel to the axis of the housing.

6. The igniter mechanism according to claim 5, wherein a recess is formed on the safety lever to receive the pull string.

7. The igniter mechanism according to claim 1, wherein a through-hole is formed at the center of the stopper.

8. The igniter mechanism according to claim 1, wherein the stopper is made of rubber.

9. The igniter mechanism according to claim 1, wherein the stopper has a diameter of 5 mm.

* * * * *